US010766125B2

(12) United States Patent
Tsai et al.

(10) Patent No.: US 10,766,125 B2
(45) Date of Patent: Sep. 8, 2020

(54) RATCHET SCREWDRIVER

(71) Applicants: Chiung-Chang Tsai, Taichung (TW); Chung-Yu Tsai, Taichung (TW)

(72) Inventors: Chiung-Chang Tsai, Taichung (TW); Chung-Yu Tsai, Taichung (TW)

( * ) Notice: Subject to any disclaimer, the term of this patent is extended or adjusted under 35 U.S.C. 154(b) by 412 days.

(21) Appl. No.: 15/805,134

(22) Filed: Nov. 6, 2017

(65) Prior Publication Data

US 2019/0134790 A1 May 9, 2019

(51) Int. Cl.
*B25B 13/46* (2006.01)
*B25B 23/00* (2006.01)
*B25B 15/04* (2006.01)

(52) U.S. Cl.
CPC ..... *B25B 13/465* (2013.01); *B25B 15/04* (2013.01); *B25B 23/0042* (2013.01)

(58) Field of Classification Search
CPC ... B25B 13/465; B25B 15/04; B25B 23/0042; B25B 13/48; B25B 13/481; B25B 13/5091; B25B 17/00; E21B 19/16
USPC ..... 81/63.1, 62; 192/43.1
See application file for complete search history.

(56) References Cited

U.S. PATENT DOCUMENTS 6,260,446 B1 * 7/2001 Hu ..... B25B 13/463 81/62
6,523,439 B1 * 2/2003 Huang ..... B25B 15/04 192/43.1
6,817,458 B1 * 11/2004 Gauthier ..... B25B 13/463 192/43.1
7,066,054 B2 * 6/2006 Liu ..... B25B 13/465 192/43.1

* cited by examiner

*Primary Examiner* — David B. Thomas
*Assistant Examiner* — Thomas Raymond Rodgers

(57) ABSTRACT

A ratchet screwdriver includes a mounting seat, a fixing ring, a control member, a driving shaft, two pawls, two springs, a fixing ring, a control member, a bead, a positioning spring and a bolt. The mounting seat has a front with a first slot, a second slot, a first extension slot, a second extension slot, a passage, a first hole and a second hole. The driving shaft has a ratchet portion. Each pawl is biased by one spring so as to be engaged with the ratchet portion. The control member is rotatably mounted to the mounting seat and the driving shaft to pivot the pawls to engage or disengage with the ratchet portion.

10 Claims, 11 Drawing Sheets

RATCHET SCREWDRIVER

The present invention is a Continuation-In-Part application of applicant's former application with the application Ser. No. 15/721,737, filed on Sep. 30, 2017.

BACKGROUND OF THE INVENTION

Field Of The Invention

U.S. Pat. No. 9,278,435 is one previous invention of the present inventors', which discloses and comprises a mounting seat 10, a driving shaft 20, four pawls 30, four springs 40, a fixing ring 50, a control member 60, a bead 70, a positioning spring 71, a C-clip 80 and a clipping member 81. The rear side of the mounting seat 10 is connected with a handle (not shown) and has a space 11 defined in the front side thereof. Two first slot 112 and two second slots 113 are defined in the inside of the space 11. The first and second slots 111, 113 are located symmetrically in opposite directions to each other. Each of the first slots 111 has a first hole 112 defined in the inner portion thereof, and each of the second slots 113 has a second hole 114 defined in the inner portion thereof. A passage 12 is defined through the mounting seat 10 and has a smaller diameter. A reception hole 13 is defined in the wall of the mounting seat 10. The mounting seat 10 has two fixing members 14 and four fixing slots 15 defined in the front side thereof. A block 16 extends from the outside of the mounting seat 10 and located in opposite to the reception hole 13.

The driving shaft 20 has a ratchet portion 21 which has a larger outer diameter and is located in the space 11. The ratchet portion 21 has multiple teeth and concavities which are located alternatively to the teeth. A section 22 with a smaller diameter extends from the rear end of the driving shaft 20 and is rotatably inserted through the passage 12. A groove 23 is defined in the outer periphery of the rear end of the driving shaft 20 and located beyond the mounting seat 10. A working end 24 is formed on the front end of the driving shaft 20 and has a polygonal recess such as a rectangular recess or a hexagonal recess, so as to be connected with a driving member, a bolt, a nut, a socket or a connection rod. An annular slot 25 is defined in the outer periphery of the driving shaft 20.

Four pawls 30 are respectively located in the first and second slots 111, 113, and each pawl 30 has a bottom insertion 31 and a top insertion 32 extending from two ends of one side thereof. The bottom insertions 31 of the pawls 30 in the first slots 111 are pivotably inserted into the first holes 112 so that each of the pawls 30 is pivotable to engage the other side thereof with one of the concavities of the ratchet portion 21. Therefore, the driving shaft 20 is driven to rotate counter clockwise by rotating the mounting seat 10 by the engagement between the pawls 30 in the first slots 111 and the ratchet portion 21 of the driving shaft 20. The bottom insertions 31 of the pawls 30 in the second slots 113 are pivotably inserted into the second holes 114 so that each of the pawls 30 is pivotable to engage the other side thereof with one of the concavities of the ratchet portion 21. Therefore, the driving shaft 20 is driven to rotate clockwise by rotating the mounting seat 10 by the engagement between the pawls 30 in the second slots 113 and the ratchet portion 21 of the driving shaft 20.

Four springs 40 are respectively located in the two first slots 111 and the two second slots 113 and provide a force to pivot the pawls 30 to engage with the ratchet portion 21. The springs 40 in the first slots 111 each are biased between the inside of the first slot 111 and the pawl 30 corresponding thereto, and the springs 40 in the second slots 113 each are biased between the inside of the second slot 113 and the pawl 30 corresponding thereto. By the force from the springs 40, the four pawls 30 are pivoted and engaged with the concavities of the ratchet portion 21.

When the driving shaft 20 is rotated counter clockwise, the teeth of the ratchet portion 21 drive the pawls 30 in the first slots 111 to compress the springs 40 on respective insides of the pawls 30 so that the driving shaft 20 is freely rotated. When the driving shaft 20 is rotated clockwise, the teeth of the ratchet portion 21 drive the pawls 30 in the second slots 113 to compress the springs 40 on respective insides of the pawls 30 so that the driving shaft 20 is freely rotated.

The fixing ring 50 is a ring-shaped member and is connected to the front side of the mounting seat 10, and has four through holes 51, two apertures 52 and four protrusions 53. The top insertions 32 of the four pawls 30 are pivotably inserted into the four through holes 51. The two fixing members 14 are inserted into the two apertures 52. The four protrusions 53 are engaged with the four fixing slots 15.

The control member 60 is rotatably mounted to the mounting seat 10 and has a mounting hole 61 defined therethrough and the driving shaft 20 rotatably extends through the mounting hole 61. Two control plates 62 symmetrically extend from the inner periphery of the mounting hole 61. When the control member 60 is rotated clockwise, the two control plates 62 pivot the two pawls 30 in the second slots 113 to compress the springs 40 and remove the two pawls 30 in the second slots 113 from the concavities of the ratchet portion 21, so that the driving shaft 20 is freely rotated counter clockwise relative to the mounting seat 10.

When the control member 60 is rotated counter clockwise, the two control plates 62 pivot the two pawls 30 in the first slots 111 to compress the springs 40 and remove the two pawls 30 in the first slots 111 from the concavities of the ratchet portion 21, so that the driving shaft 20 is freely rotated clockwise relative to the mounting seat 10. The control member 60 has three positioning slots 63 and a restriction slot 64 defined therein. The block 16 is movable in the restriction slot 64. When the block 16 contacts one end of the restriction slot 64, the two control plates 62 remove the two pawls 30 in the first slots 111 from the concavities of the ratchet portion 21. When the block 16 contacts the other end of the restriction slot 64, the two control plates 62 remove the two pawls 30 in the second slots 113 from the concavities of the ratchet portion 21. The bead 70 is axially and movably located in the reception hole 13. The positioning spring 71 is located in the reception hole 13 and biases the bead 70 outward to be engaged with one of the positioning slots 63, so as to position the control member 60 at a first position where the driving shaft 20 is freely rotated counter clockwise, a second position where the driving shaft 20 cannot rotate freely, and a third position where the driving shaft 20 is freely rotated clockwise.

The C-clip 80 is engaged with the groove 23 of the driving shaft 20 and restricts the driving shaft 20 from being separated from the front side of the mounting seat 10. The clipping member 81 is engaged with the annular slot 25 of the driving shaft 20 to restrict the control member 60 from being separated from the front side of the mounting seat 10.

The disadvantages of the above-mentioned previous patent are: 1) the two pawls 30 are pivoted in the first slots 111 and second slots 113 by bottom insertion 31 and top insertion 32 inserting in the first hole 112 and second hole 114 respectively so as to be pivotable to engage with the ratchet portion 21, but the pawl 30 only use their distal ends to engage one concavity between two teeth of the ratchet portion 21, so the drive torque is very lower; and 2) the bottom insertion 31 and top insertion 32 of the pawls 30 are in plate shape, so that they are unstable when insert in the first hole 112 and second hole 114.

The present invention intends to provide a ratchet driving device for a ratchet screwdriver to improve the shortcomings of the prior arts mentioned above.

SUMMARY OF THE INVENTION

The present invention relates to a ratchet screwdriver and comprises a mounting seat, a fixing ring, a control member, a driving shaft, two pawls, two springs, a fixing ring, a control member, a bead, a positioning spring and a bolt. The mounting seat has a front with a first slot, a second slot, a first extension slot, a second extension slot, a passage, a first hole and a second hole. The driving shaft has a ratchet portion. Each pawl is biased by one spring so as to be engaged with the ratchet portion. The control member is rotatably mounted to the mounting seat and the driving shaft to pivot the pawls to switch to engage or disengage with the ratchet portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
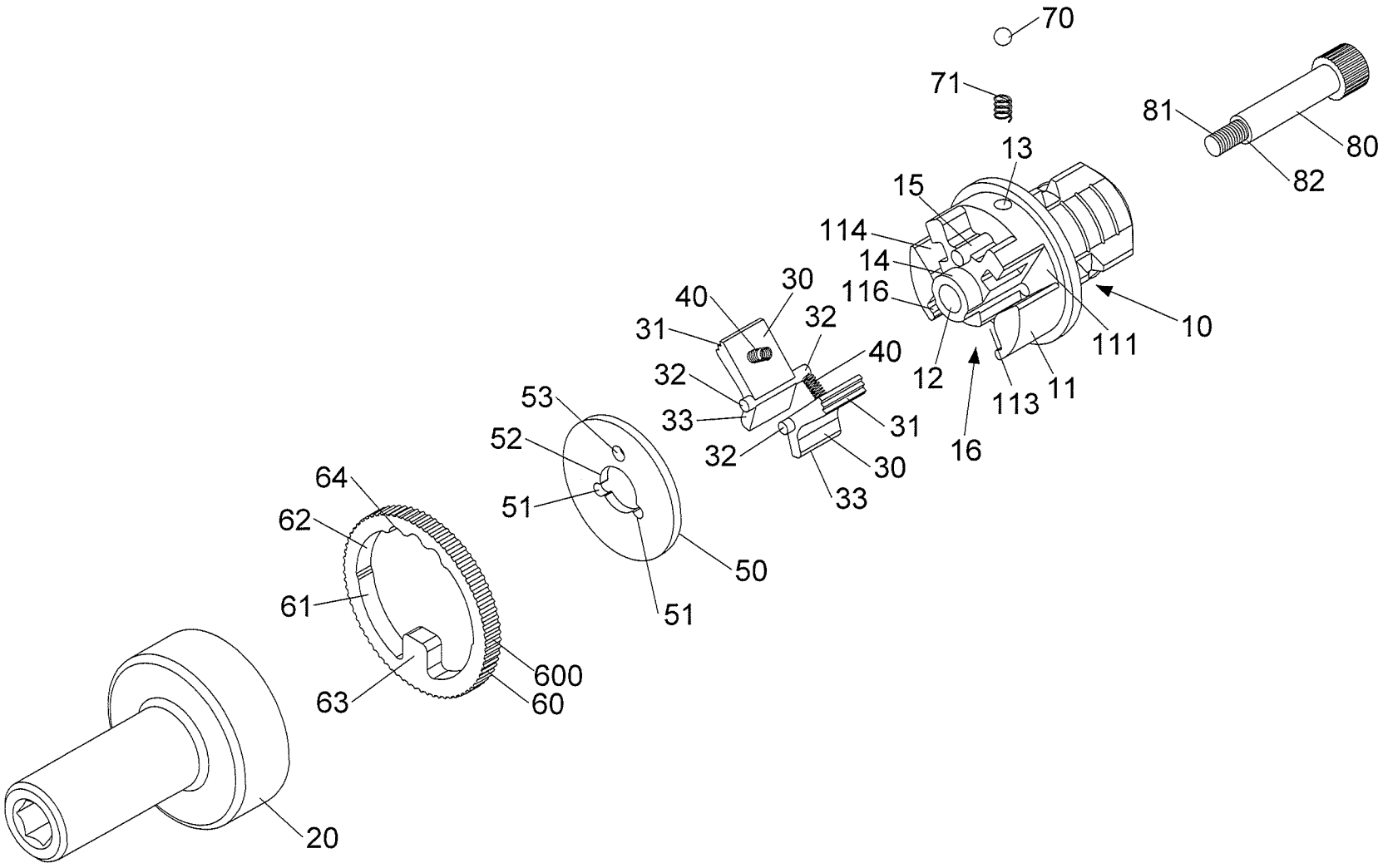
FIG. 1 is an exploded view of the ratchet screwdriver of the present invention.
Figure 3:
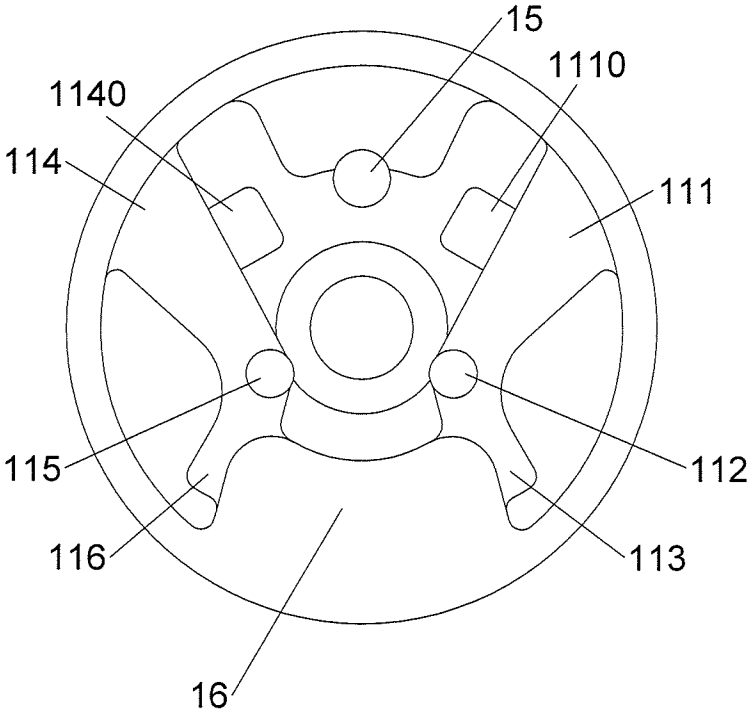
FIG. 3 is a plane view to show the front side of the mounting seat of the ratchet screwdriver of the present invention.
Figure 2:
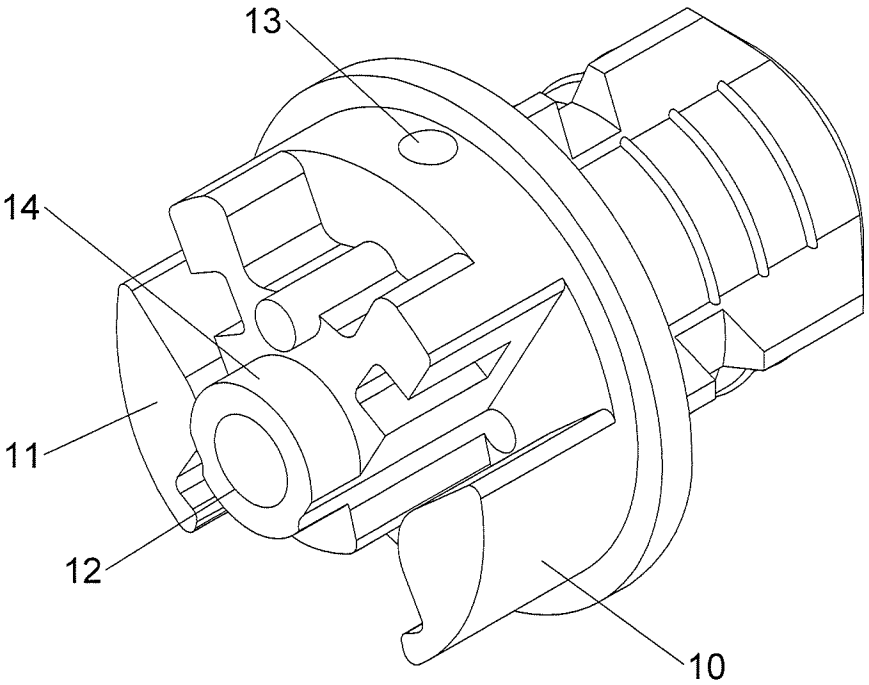
FIG. 2 is a perspective view to show the mounting seat of the ratchet screwdriver of the present invention.
Figure 4:
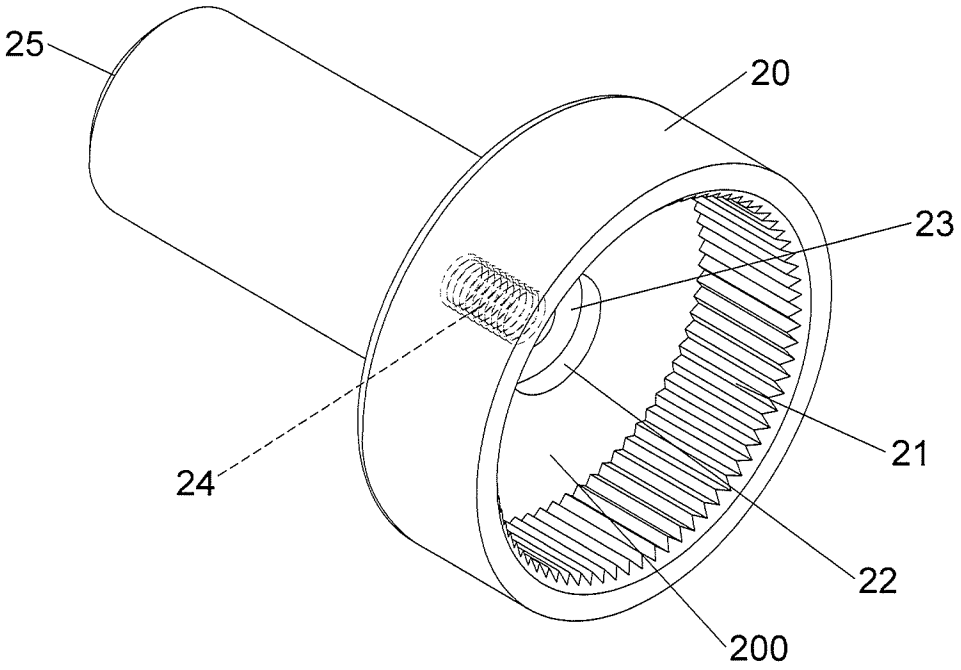
FIG. 4 is a perspective view to show the rear side of the control member of the ratchet screwdriver of the present invention.
Figure 5:
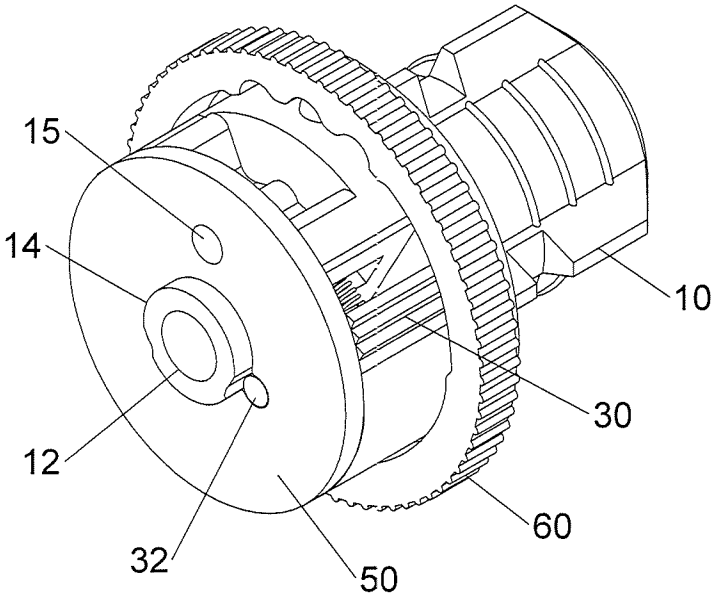
FIG. 5 is a perspective view to show a partial combination of the control member of the ratchet screwdriver of the present invention.
Figure 6:
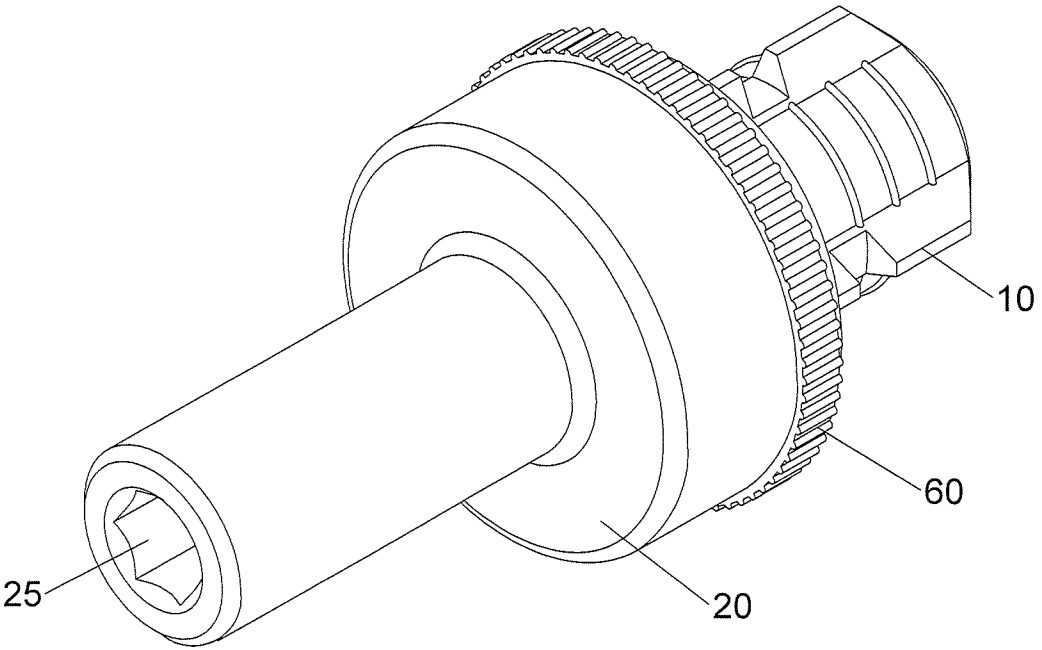
FIG. 6 is a perspective view to show a complete combination of the control member of the ratchet screwdriver of the present invention.
Figure 8:
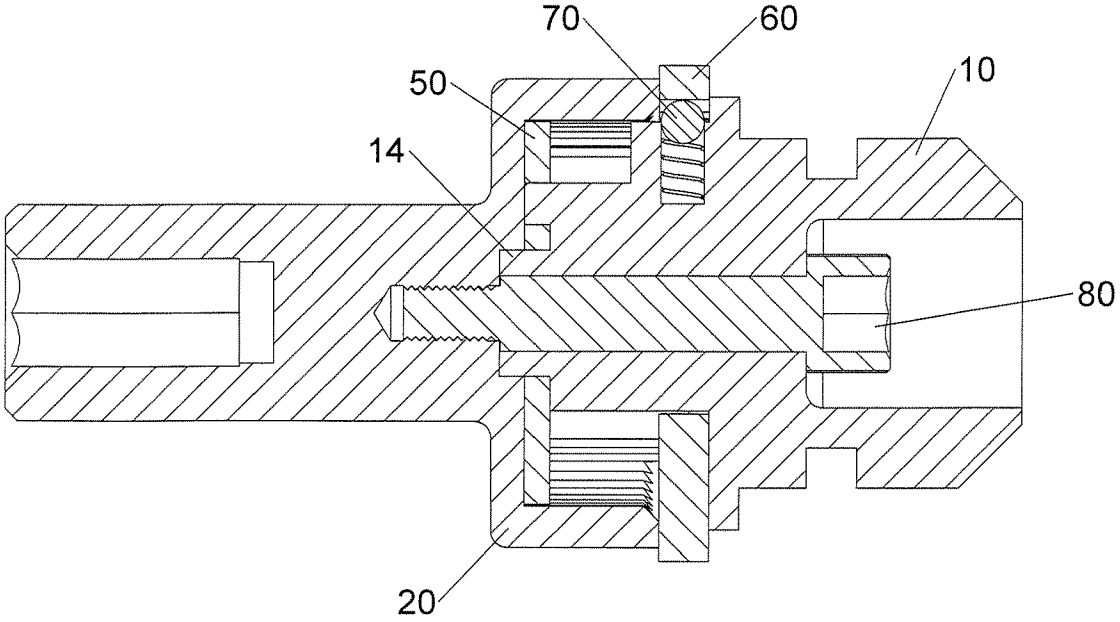
FIG. 8 is a cross sectional view taken along line 8-8 in FIG. 7.
Figure 7:
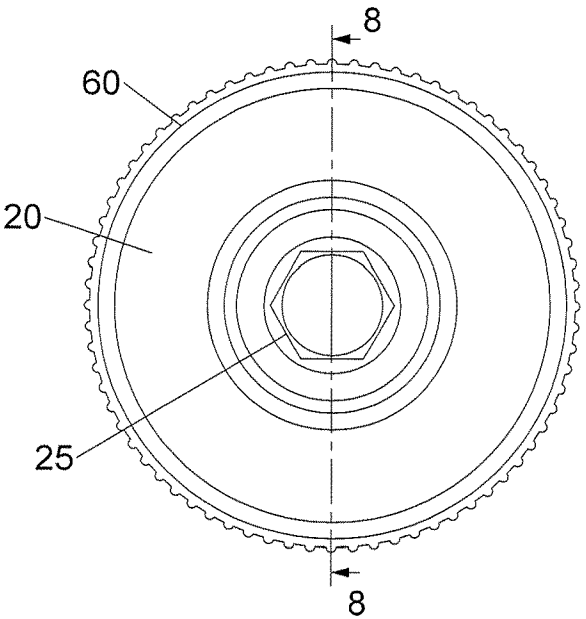
FIG. 7 is a front end view of the control member of the ratchet screwdriver of the present invention.
Figure 9:
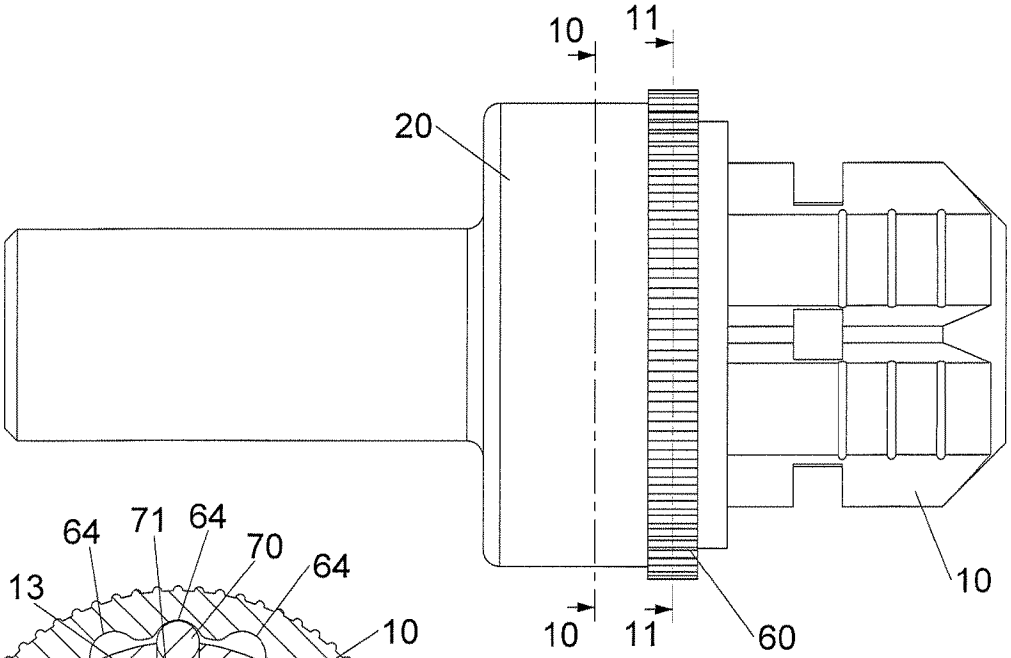
FIG. 9 is a side view of the control member of the ratchet screwdriver of the present invention.
Figure 11:
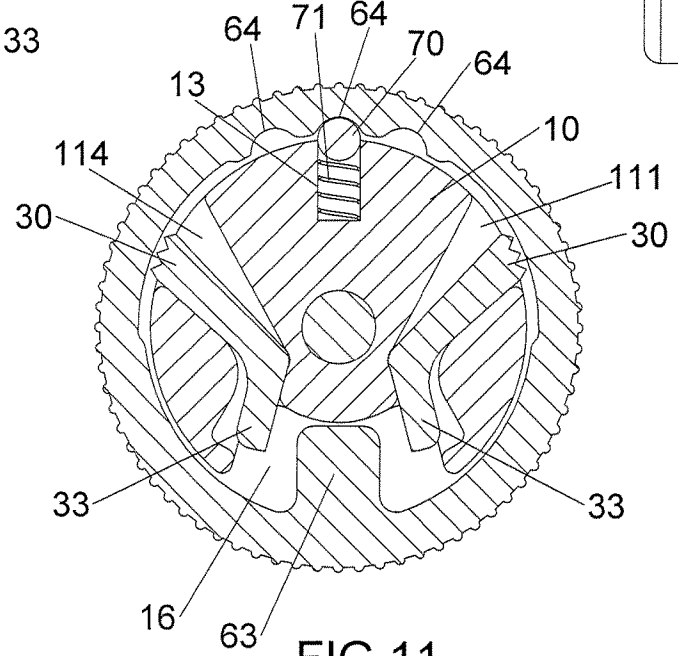
FIG. 11 is a cross sectional view taken along line 11-11 in FIG. 9.
Figure 10:
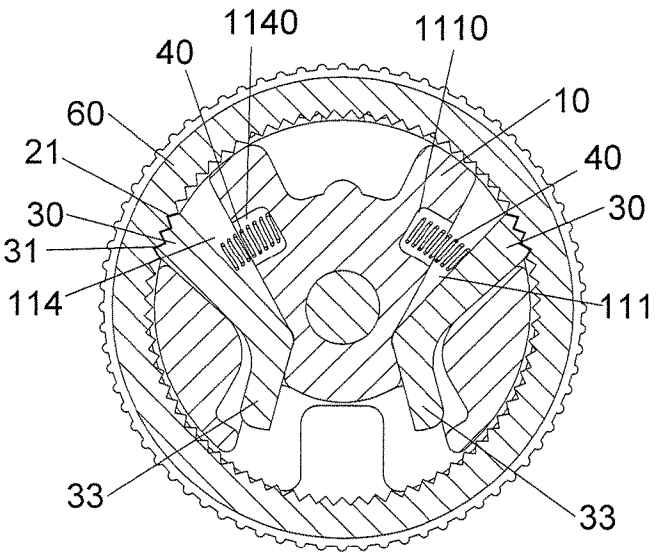
FIG. 10 is a cross sectional view taken along line 10-10 in FIG. 9.

Referring to FIGS. 1 to 11, the ratchet screwdriver of the present invention comprises a mounting seat 10, a driving shaft 20, two pawls 30, two springs 40, a fixing ring 50, a control member 60, a bead 70, a positioning spring 71 and a bolt 80 having a screwed portion 81. The rear side of the mounting seat 10 is connected with a handle (not shown) and has a front portion 11 defined in the front side thereof. A first slot 111, a second slot 114, a first extension slot 113 and a second extension slot 116 are defined in the inside of the front portion 11, i.e. they recessed from the front end of the front portion 11. The first and second slots 111, 114 are located symmetrically in opposite directions to each other. The first and second extension slots 113, 116 are located symmetrically in opposite directions to each other. The first slot 111 has a first hole 112 defined in the inner portion thereof, and the second slot 114 has a second hole 115 defined in the inner portion thereof. The first extension slot 113 with an inclined face is connected with one end of the first slot 111. The second extension slot 116 with an inclined face is connected with one end of the second slot 114. The first and second holes 112, 115 are located symmetrically in opposite directions to each other, and they are located at the connection of the first slot 111 and the first extension slot 113, and the connection of the second slot 114 and the second extension slot 116 respectively. A pivotal portion 14 protrudes from the central area of the front end of the front portion 11. A fixing rod 15 protrudes from the front end of the front portion 11 and locates at lateral side of the pivotal portion 14 with a distance. A passage 12 is defined through the mounting seat 10 and has a smaller diameter, and coaxially extending through the pivotal portion 14. A reception hole 13 is defined in one side of outer periphery of the front portion 11 of the mounting seat 10. A recessed slot 16 is recessed from another side of outer periphery of the front portion 11 and located in opposite to the reception hole 13, and has one open end located at the front end of the front portion 11.

A circular receiving space 200 is recessed from the central area of the rear end of the driving shaft 20. The receiving space 200 is for receiving the front portion 11 of the mounting seat 10. A ratchet portion 21 is circularly distributed on the inner periphery of the receiving space 200. A pivotal hole 22 is recessed from the bottom of the receiving space 200 and is for pivotably receiving the pivotal portion 14. A screwed hole 24 is recessed from the bottom 23 of the pivotal hole 22. The ratchet portion 21 has multiple teeth and concavities which are located alternatively to the teeth. A function end 25 is defined on the front end of the driving shaft 20, and has a polygonal recess such as a rectangular recess or a hexagonal recess, or has a polygonal rod such as square rod, so as to be connected with a driving member, a bolt, a nut, a socket or a connection rod.

Two pawls 30 are respectively located in the first and second slots 111, 114 and are located symmetrically in opposite directions to each other with respect to the mounting seat 10. One front end of each pawl 30 has an engaging portion 31 with multiple teeth for engaging with the teeth of the ratchet portion 21. Each pawl 30 has a cylindrical pivot 32 with two ends protruding from two lateral sides of the rear end of each pawl 30. The rear end of each pawl 30 extends a contact portion 33. The cylindrical pivots 32 of the pawls 30 in the first and second slots 111, 114 are respectively pivotably inserted into the first and second holes 112, 115, so that the two pawls 30 are rotatable to engage with the teeth of the ratchet portion 21 by their teeth. The engaging portions 31 of the two pawls 30 are respectively located in the first and second slots 111, 114, and the contact portions 33 of the two pawls 30 are respectively located in the first and second extension slot 113, 116. Therefore, the driving shaft 20 is driven to rotate counter clockwise or clockwise by rotating the mounting seat 10 by the engagement between the teeth of the engaging portion 31 of the pawls 30 in the first and second slots 111, 114 and the teeth of the ratchet portion 21 of the driving shaft 20.

Two springs 40 are respectively located in the first and second slots 111, 114 and provide elastic forces to pivot the two pawls 30 to engage with the teeth of the ratchet portion 21 by the teeth of their engaging portions 31. The spring 40 in the first slot 111 is biased between the inside of the first slot 111 and one pawl 30 corresponding thereto, and the spring 40 in the second slot 114 is biased between the inside of the second slot 114 and the other pawl 30 corresponding thereto. By the force from the springs 40, the teeth of the engaging portions 31 of the two pawls 30 are pivoted and engaged with the teeth of the ratchet portion 21. Two recessed holes 1110, 1140 are defined on lateral sides of the first and second slots 111, 114 for receiving one end of the two springs 40 respectively.

The fixing ring 50 is a ring-shaped member having one through hole 52 at central area, two apertures 51 and one positioning hole 53. The fixing ring 50 is connected to the front side of the mounting seat 10 and is fixedly mounted on the pivotal portion 14. The other ends of the cylindrical pivots 32 of the two pawls 30 are pivotably inserted into the two apertures 51. The positioning hole 53 is engaged with the fixing rod 15, so that the fixing ring 50 can't rotate with respect to the mounting seat 10.

The ring shaped control member 60 with an outer periphery defined multiple teeth 600 thereon is rotatably mounted on the outer periphery of the front portion 11 of the mounting seat 10 and has a mounting hole 61 defined therethrough. A circular flange 100 protrudes from the outer periphery of the rear end of the front portion 11. The control member 60 is limited between the circular flange 100 and the rear end of the driving shaft 20 so that he control member 60 can't be apart from the mounting sear 10. A push portion 63 extends from one side of the inner wall of the inner space 62 of the mounting hole 61, and the distal portion of the push portion 63 inserts into the recessed slot 16. When the control member 60 is rotated counter clockwise with respect to the mounting seat 10, the push portion 63 pivots the contact portion 33 of one pawl 30 in the first slot 111 to compress the spring 40 and remove the teeth of engaging portion 31 of the pawl 30 in the first slot 111 from the teeth of the ratchet portion 21, so that the driving shaft 20 is freely rotated clockwise relative to the mounting seat 10. When the control member 60 is rotated clockwise with respect to the mounting seat 10, the push portion 63 pivots the contact portion 33 of one pawl 30 in the second slot 114 to compress the spring 40 and remove the teeth of engaging portion 31 of the pawl 30 in the second slot 114 from the teeth of the ratchet portion 21, so that the driving shaft 20 is freely rotated counter clockwise relative to the mounting seat 10.

Another side of the inner wall of the inner space 62 of the mounting hole 61 of the control member 60 opposite to the push portion 63 has three positioning slots 64 defined therein. The push portion 63 is movable in the recessed slot 16. When the control member 60 is rotated clockwise with respect to the mounting seat 10 and from a second position to a first position, the push portion 63 contacts one end of the recessed slot 16 and pivots the pawl 30 in the second slot 114 to compress the spring 40, and remove the teeth of the engaging portion 31 of one pawl 30 in the second slot 114 from the teeth of the ratchet portion 21, so that the driving shaft 20 is freely rotated counter clockwise relative to the mounting seat 10. When the control member 60 is rotated counter clockwise with respect to the mounting seat 10 and from the second position to a third position, the push portion 63 contacts another end of the recessed slot 16 and pivots the pawl 30 in the first slot 111 to compress the spring 40, and removes the teeth of the engaging portion 31 of the pawl 30 in the first slot 111 from the teeth of the ratchet portion 21, so that the driving shaft 20 is freely rotated clockwise relative to the mounting seat 10. When the control member 60 is at the second position with respect to the mounting seat 10, the teeth of the engaging portion 31 of the two pawls 30 engage with the teeth of the ratchet portion 21, so that the driving shaft 20 is rotatable clockwise and counter clockwise together with the mounting seat 10. The bead 70 is axially and movably located in the reception hole 13. The positioning spring 71 is located in the reception hole 13 and biases the bead 70 outward to be engaged with one of the three positioning slots 64, so as to position the control member 60 at the first position where the driving shaft 20 is freely rotated counter clockwise, the second position where the driving shaft 20 cannot rotate freely, and the third position where the driving shaft 20 is freely rotated clockwise.

The bolt 80 is inserted into the passage 12 and screwed with the screwed hole 24 of the driving shaft 20 by its screwed portion 81, so as to restrict the driving shaft 20 from being separated from the mounting seat 10. A contact face 82 is defined on rear end of the screwed portion 81 is for contacting with the bottom 23 of the pivotal hole 22. The distal end of the pivotal portion 14 contacts the bottom 23 of the pivotal hole 22.

Figure 12:
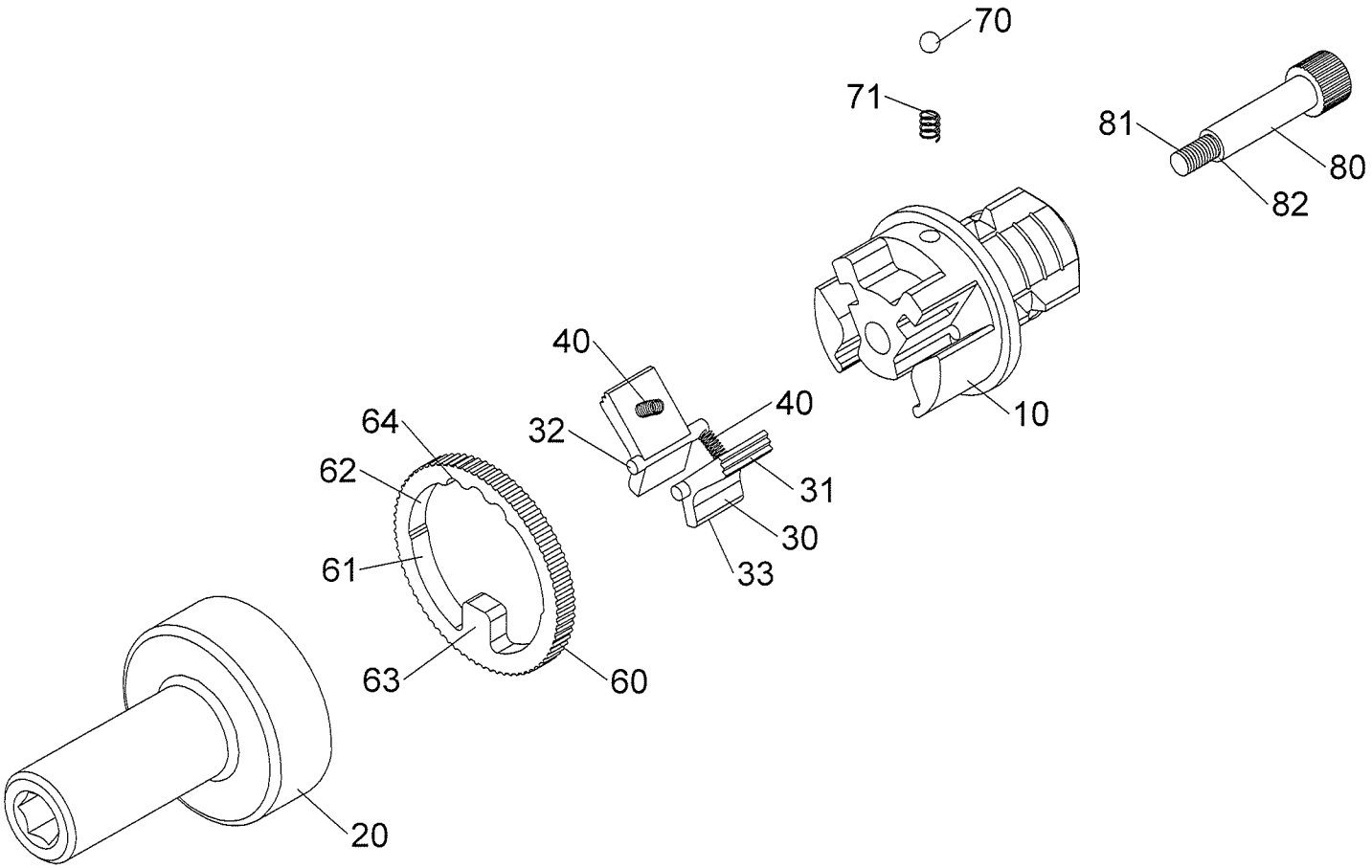
FIG. 12 shows an exploded view of a second embodiment of the ratchet screwdriver of the present invention.

As shown in FIG. 12 which shows the second embodiment of the present invention wherein the mounting seat 10 has no the pivotal portion 14, the fixing rod 15 and the fix ring 50 shown in FIG. 1.

Figure 13:
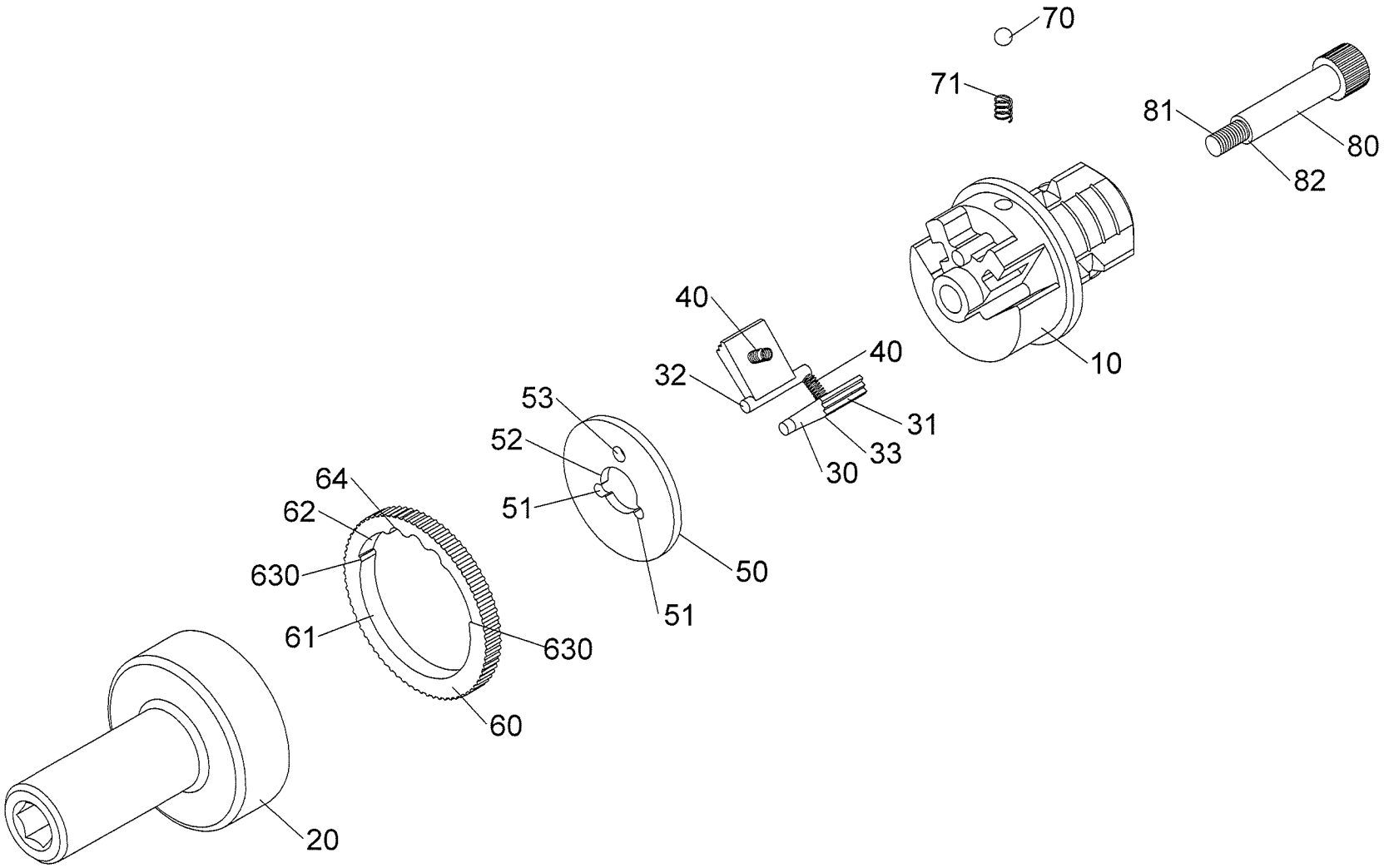
FIG. 13 shows an exploded view of a third embodiment of the ratchet screwdriver of the present invention.
Figure 15:
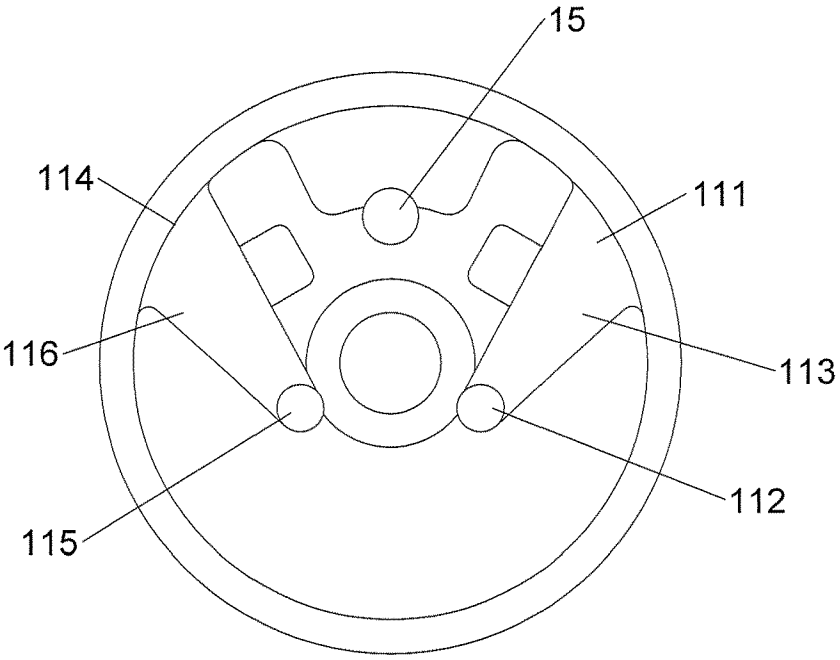
FIG. 15 is a front end view of the mounting seat of the third embodiment of the ratchet screwdriver of the present invention.
Figure 14:
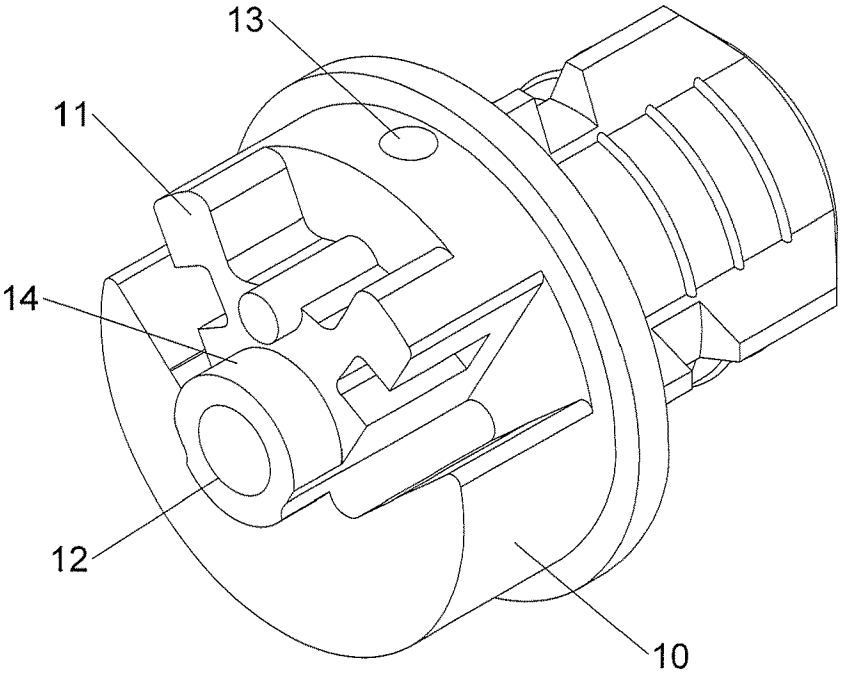
FIG. 14 is a perspective view to show the mounting seat of the third embodiment of the ratchet screwdriver of the present invention.

As shown in FIGS. 13 to 15 which show the third embodiment of the present invention wherein the difference is that there is no recessed slot 16 shown in FIG. 1, the first and second extension slot 113, 116 invaginate connect with lateral sides of the first and second slots 111, 114, the contact portion 33 of each pawl 30 is positioned between the engaging portion 31 and the pivot 32, and two push portions 630 symmetrically protrudes from the wall of the mounting hole 61 and directs to the central of the inner space 62 for pushing the contact portions 33 in the first and second slots 111, 114 respectively.

Figure 16:
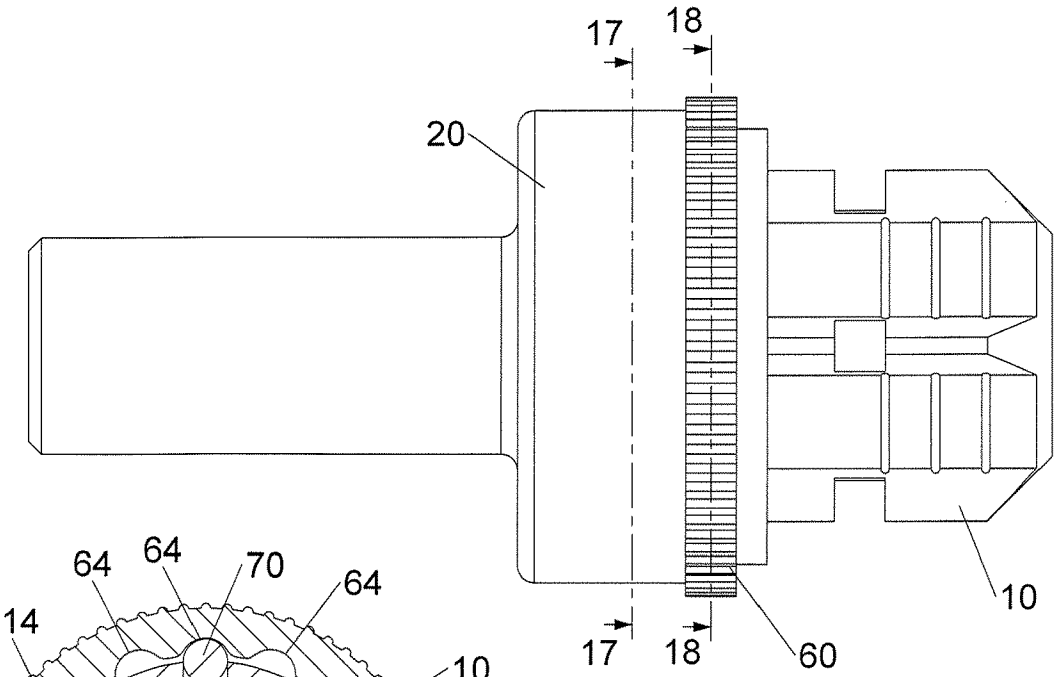
FIG. 16 is a side view of the third embodiment of the ratchet screwdriver of the present invention.
Figure 18:
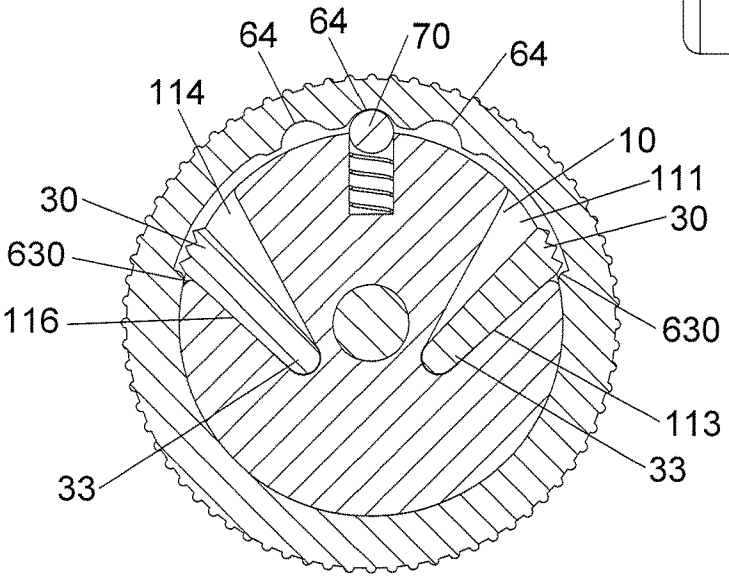
FIG. 18 is a cross sectional view taken along line 18-18 in FIG. 16.
Figure 17:
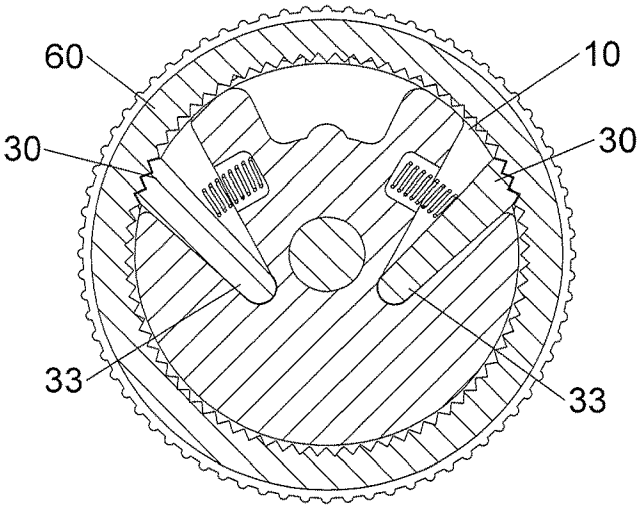
FIG. 17 is a cross sectional view taken along line 17-17 in FIG. 16.

As shown in FIGS. 16 to 18, when the control member 60 is rotated counter clockwise with respect to the mounting seat 10 to the first position, the push portion 630 contacts the contact portion 33 and pivots the pawl 30 in the first slot 111 to compress the spring 40, and removes the teeth of the engaging portion 31 of the pawl 30 in the first slot 111 from the teeth of the ratchet portion 21, so that the driving shaft 20 is freely rotated clockwise relative to the mounting seat 10. When the control member 60 is rotated clockwise with respect to the mounting seat 10 to the third position, the push portion 630 contacts the contact portion 33 and pivots the pawl 30 in the second slot 114 to compress the spring 40, and removes the teeth of the engaging portion 31 of the pawl 30 in the second slot 114 from the teeth of the ratchet portion 21, so that the driving shaft 20 is freely rotated counter clockwise relative to the mounting seat 10. When the control member 60 is at the second position with respect to the mounting seat 10, the teeth of the engaging portions 31 of the two pawls 30 engage with the teeth of the ratchet portion 21 together, so that the driving shaft 20 is rotatable clockwise and counter clockwise together with the mounting seat 10.

The advantages of the present invention are as followings:

1. the two pawls 30 received in the first and second slots 111, 114 each is pressed by an elastic force of one spring 40 and has an engaging portions 31 with multiple teeth at lateral side, so that the engaging portions 31 engage with the ratchet portion 21 by multiple teeth, and so that the screwdriver has more effective driving torque;

2. the two pawls 30 have cylindrical pivots 32 pivotably inserted into the first and second holes 112, 115, and apertures 51 of the fixing ring 50, so that the two pawls 30, the fixing ring 50 and the mounting seat 10 are mounted stably;

3. The pivotal portion 14 inserts into the pivotal hole 22 and the through hole 52, and the fixing ring 50 is pivotally received in the receiving space 200, and 4. The bolt 80 is inserted into the passage 12 and screwed with the screwed hole 24 of the driving shaft 20 by its screwed portion 81.

While we have shown and described the embodiment in accordance with the present invention, it should be clear to those skilled in the art that further embodiments may be made without departing from the scope of the present invention.

What is claimed is:

1. A ratchet screwdriver comprising:

a mounting seat having a front portion defined in a front side thereof; a first slot, a second slot, a first extension slot and a second extension slot being recessed from a front end of the front portion; the first and second slots being located symmetrically in opposite directions to each other; the first and second extension slots being located symmetrically in opposite directions to each other; the first slot and the second slot respectively having a first hole and a second hole defined in an inner portion thereof; the first and second holes being located symmetrically in opposite directions to each other; a pivotal portion protruding from a central area of the front end of the front portion; a fixing rod protruding from the front end of the front portion and locating at a lateral side of the pivotal portion with a distance; a passage being defined through the mounting seat and coaxially extending through the pivotal portion; a reception hole being defined in an outer periphery of the front portion;

a driving shaft having a rear end defined a circular receiving space therein; the receiving space being for receiving the front portion; a ratchet portion with multiple teeth being circularly distributed on an inner periphery of the receiving space; a pivotal hole being recessed from a bottom of the receiving space for pivotably receiving the pivotal portion; a screwed hole being recessed from a bottom of the pivotal hole; a function end being defined on a front end of the driving shaft;

two pawls being respectively located in the first and second slots and being located symmetrically in opposite directions to each other with respect to the mounting seat;

a front end of each pawl having an engaging portion with multiple teeth for engaging with the teeth of the ratchet portion; each pawl having a cylindrical pivot with two ends protruding from two lateral sides of a rear end of each pawl; each pawl having a contact portion; one end of the cylindrical pivots of the two pawls being respectively pivotably inserted into the first and second holes so that the engaging portions of the two pawls are rotatable to engage with the ratchet portion; the engaging portions of the two pawls being respectively located in the first and second slots, and the contact portions of the two pawls being respectively located in the first and second extension slots;

two springs being respectively located in the first and second slots for providing elastic forces to pivot the two pawls to engage with the teeth of the ratchet portion by the teeth of the engaging portions; one spring in the first slot being biased between an inside of the first slot and one pawl corresponding thereto, and the other spring in the second slot being biased between an inside of the second slot and the other pawl corresponding thereto;

a fixing ring having a through hole, two apertures and a positioning hole; the fixing ring being connected to the front side of the mounting seat and fixedly mounted on the pivotal portion; the other ends of the cylindrical pivots of the two pawls being pivotably inserted into the two apertures respectively; the positioning hole being engaged with the fixing rod;

a ring shaped control member being rotatably mounted on an outer periphery of the front portion and having a mounting hole defined therethrough; the mounting hole being for the front portion penetrating; at least one push portion extending from an inner wall of an inner space of the mounting hole; the inner wall of the inner space having three positioning slots defined thereon; wherein when the control member being rotated clockwise with respect to the mounting seat from a second position to a first position, the at least one push portion pivoting the pawl in the second slot to compress one spring and remove the teeth of the engaging portion of one pawl in the second slot from the teeth of the ratchet portion so that the driving shaft being freely rotated counter clockwise relative to the mounting seat; wherein when the control member being rotated counter clockwise with respect to the mounting seat from the second position to a third position, the at least one push portion pivoting the pawl in the first slot to compress the other spring and removes the teeth of the engaging portion of the pawl in the first slot from the teeth of the ratchet portion so that the driving shaft is freely rotated clockwise relative to the mounting seat; wherein when the control member being at the second position with respect to the mounting seat, the teeth of the engaging portions of the two pawls engaging with the teeth of the ratchet portion so that the driving shaft is rotatable clockwise and counter clockwise together with the mounting seat;

a bead being axially and movably located in the reception hole; a positioning spring being located in the reception hole to elastically push the bead outward to engage with the three positioning slots respectively so as to position the control member at the first, second and third positions with respect to the mounting seat respectively, and a bolt being inserted into the passage; one end of the bolt defined a screwed portion thereon to be screwed with the screwed hole of the driving shaft so as to restrict the driving shaft from being separated from the mounting seat.

2. The ratchet screwdriver as claimed in claim 1, wherein the first and second extension slots extend from one end of the first and second slots respectively; the contact portions of the two pawls extend into the first and second extension slots respectively; a recessed slot is recessed from an outer periphery of the front portion and connects the first and second extension slots respectively; the at least one push portion is one push portion, the push portion is inserted into the recessed slot to pivot the contact portions of the two pawls in the first and second extension slots respectively.

3. The ratchet screwdriver as claimed in claim 1, wherein the first and second extension slots invaginate with respect to the first and second slots respectively and connect with lateral sides of the first and second slots respectively, the contact portions are positioned between the engaging portions and the pivots of the two pawls respectively; and two push portions symmetrically protrudes from the inner wall of the mounting hole for pushing the contact portions in the first and second slots respectively.

4. The ratchet screwdriver as claimed in claim 1, wherein a rear end of the mounting seat is for connecting a handle.

5. The ratchet screwdriver as claimed in claim 1, wherein a working end of the driving shaft has a polygonal recess.

6. The ratchet screwdriver as claimed in claim 1, wherein a working end of the driving shaft has a polygonal rod.

7. The ratchet screwdriver as claimed in claim 1, wherein a contact face is defined on a rear end of the screwed portion for contacting with the bottom of the pivotal hole, and a distal end of the pivotal portion contacts the bottom of the pivotal hole.

8. The ratchet screwdriver as claimed in claim 1, wherein a circular flange protrudes from an outer periphery of a rear end of the front portion; and the control member is limited between the circular flange and the rear end of the driving shaft.

9. The ratchet screwdriver as claimed in claim 1, wherein an outer periphery of the control member has multiple teeth.

10. The ratchet screwdriver as claimed in claim 1, wherein two recessed holes are respectively defined on two lateral sides of the first and second slots for receiving one end of the two springs respectively.

* * * * *